US005571002A

United States Patent [19]

Yokoi

[11] Patent Number: 5,571,002

[45] Date of Patent: Nov. 5, 1996

[54] PLUNGER PUMP SYSTEM WITH SHUTTLE VALVE

[75] Inventor: Keiji Yokoi, Tokyo, Japan

[73] Assignee: Ebara Corporation, Tokyo, Japan

[21] Appl. No.: 418,622

[22] Filed: Apr. 7, 1995

Related U.S. Application Data

[62] Division of Ser. No. 162,290, Dec. 7, 1993, Pat. No. 5,454,698.

[30] Foreign Application Priority Data

Dec. 9, 1992 [JP] Japan ..... 4-352007

[51] Int. Cl.[6] ..... F04B 7/02

[52] U.S. Cl. ..... 417/507; 417/518; 137/625.18

[58] Field of Search ..... 417/507, 518, 417/446, 458, 560; 137/625.18

[56] References Cited

U.S. PATENT DOCUMENTS

| | | | |
|---|---|---|---|
| 2,930,391 | 3/1960 | Bass et al. | 137/625.18 |
| 3,184,812 | 5/1965 | Bennett et al. | 417/507 X |
| 3,533,429 | 10/1970 | Shoulders | 417/507 X |
| 3,631,876 | 1/1972 | Misevich | 137/625.18 X |
| 3,704,080 | 11/1972 | Cross | 417/518 X |
| 4,460,152 | 7/1984 | DiPasquale et al. | 417/507 X |

FOREIGN PATENT DOCUMENTS

| | | |
|---|---|---|
| 63-266176 | 11/1988 | Japan . |
| 3-217665 | 9/1991 | Japan . |
| 4-140483 | 5/1992 | Japan . |

*Primary Examiner*—Richard E. Gluck
*Attorney, Agent, or Firm*—Armstrong, Westerman, Hattori, McLeland & Naughton

[57] ABSTRACT

A plunger pump system including a plunger pump, and a shuttle valve connected to the plunger pump having a valve body reciprocally fitted in a hollow portion formed in a valve casing to divide the hollow portion into a liquid supply side chamber and a liquid discharge side chamber. The shuttle valve has a liquid supply hole which provides communication between a liquid supply line and the liquid supply side chamber and which is closed by a first end surface of the valve body when the delivery pressure of the liquid is higher than the supply pressure of the liquid. A first connecting hole provides communication between the pump liquid supply hole and the liquid supply side chamber. A liquid discharge hole provides communication between a liquid discharge line and the liquid discharge side chamber and is closed by a second end surface of the valve body when the supply pressure of the liquid is higher than the delivery pressure of the liquid. A second connecting hole provides communication between the pump liquid discharge hole and the liquid discharge side chamber, and prevents generation of dust, leakage of liquid, and occurrence of a failure at a valve driving portion of a plunger pump system.

4 Claims, 7 Drawing Sheets

PLUNGER PUMP SYSTEM WITH SHUTTLE VALVE

This is a division, of application Ser. No. 08/162,290 filed Dec. 7, 1993, now U.S. Pat. No. 5,454,698.

BACKGROUND OF THE INVENTION

1. Field of the Art

The present invention relates to a pump system for supplying an ultraclean liquid to a high-pressure jet washing machine employed in a cleaning process where a high degree of cleanliness is required as in the manufacture of semiconductors, liquid crystals, etc. More particularly, the present invention relates to a plunger pump system with a shuttle valve.

2. Prior Art

The manufacture of semiconductors, liquid crystals, etc. needs a cleaning process that requires a high degree of cleanliness. A jet washing machine used in such a cleaning process is supplied with an ultraclean liquid by a plunger pump system, for example.

FIG. 8 shows the general arrangement of a plunger pump system which has heretofore been commonly employed. As illustrated, the plunger pump system 1 has a plunger pump 2 for supplying a pressurized liquid, and a stop valve 3 for preventing the liquid from flowing out from a nozzle 4 by the supply pressure of the liquid when the plunger pump 2 is standing by. The plunger pump system 1 is adapted to spray a jet of liquid from the nozzle 4 into a jet washing machine 5 only when the stop valve 3 is open.

The plunger pump 2 has a plunger 6 that reciprocates in a cylinder 7 to pressurize the liquid sucked into a pump chamber 9 from a pump liquid supply hole 8 and to discharge the pressurized liquid from a pump liquid discharge hole 10. A check valve 11 is incorporated in the pump liquid supply hole 8 so that the liquid supplied into the pump chamber 9 during the suction stroke will not flow back during the delivery stroke.

The ultraclean liquid that has been pressurized to a high level by the plunger pump 2 is sent to the stop valve 3. The stop valve 3 has a valve unit 12 through which the liquid passes, and a valve driving unit 13 for driving the valve unit 12.

Accordingly, when cleaning is to be carried out, the stop valve 3 is opened to supply the jet washing machine 5 with a high-pressure liquid from the plunger pump 2. On the other hand, when cleaning is not carried out, the plunger pump 2 is suspended in a stand-by state, and the stop valve 3 is closed by the valve driving unit 13 to prevent the liquid in the pump from flowing out to the jet washing machine 5.

In the above-described plunger pump system, however, since the stop valve 3 is provided with a shaft seal mechanism, e.g., a gland packing, a bellows, or a diaphragm, at a sliding portion that connects together the valve unit 12 and the valve driving unit 13, the conventional plunger pump system 1 involves the following problems: generation of dust or powder from the seal mechanism due to friction; leakage of liquid to the outside through the seal mechanism; and failure of the shaft seal mechanism. Also, a special maintenance is required to properly operate the valve driving unit.

SUMMARY OF THE INVENTION

In view of the above-described circumstances, it is an object of the present invention to prevent generation of dust from a valve, leakage of liquid through the valve and failure of a seal mechanism and to provide a clean and maintenance-free plunger pump system.

To attain the above-described object, in one aspect of the present invention, a plunger pump system includes a plunger pump, having a plunger which reciprocates in a cylinder, so that a liquid, is sucked into a pump chamber from a pump liquid supply hole through a check valve. This allows the liquid to flow only in the direction of the pump chamber, is pressurized in the pump chamber and discharged from a pump liquid discharge hole. A shuttle valve, connected to the plunger pump, has a valve body reciprocatably fitted in a hollow portion and forms a valve casing dividing the hollow portion into a liquid supply side chamber and a liquid discharge side chamber. The shuttle valve has a liquid supply hole which provides communication between a liquid supply line and the liquid supply side chamber and is closed by a first end surface of the valve body when the liquid pressure in the liquid discharge side chamber is higher than the liquid pressure in the liquid supply side chamber. A first connecting hole communicates the pump liquid supply hole with the liquid supply side chamber. A liquid discharge hole communicates a liquid discharge line and the liquid discharge side chamber and is closed by a second end surface of the valve body when the liquid pressure in the liquid supply side chamber is higher than the liquid pressure in the liquid discharge side chamber. A second connecting hole communicates the pump liquid discharge hole and the liquid discharge side chamber.

The check valve may be incorporated in the pump liquid supply hole or in a liquid supply line connecting the pump liquid supply hole and the first connecting hole of the shuttle valve.

The check valve may be incorporated in the shuttle valve. In this case, the pump liquid supply hole and the pump liquid discharge hole are formed as a commmon hole. The first connecting hole and the second connecting hole are communicated with each other by means of a passage formed in the shuttle valve. The check valve is provided in the passage. The common hole of the pump is connected to the passage at the lower stream side of the check valve.

The shuttle valve may be formed independently of the plunger pump and the common hole is connected to the passage through a liquid supply line or the shuttle valve may be integrally formed with the plunger pump and the common hole is directly connected to the passage.

A spring member may be disposed in the hollow portion in the shuttle valve for biasing the valve body toward the liquid discharge hole of the shuttle valve to assist the supply pressure of the liquid.

In another aspect of the present invention, a plunger pump system includes a plunger pump having a plunger which reciprocates in a cylinder so that a liquid, which is sucked into a pump chamber from a pump liquid supply hole through a check valve. This allows the liquid to flow only in the direction of the pump chamber where such liquid is pressurized and discharged from a pump liquid discharge hole. A shuttle valve connected to the plunger pump has a valve body reciprocatably fitted in a hollow portion formed in a valve casing and divides the hollow portion into a liquid pressure supply chamber and a liquid discharge side chamber. The liquid is directly supplied to the pump chamber from a liquid supply source without passing through the shuttle valve. The shuttle valve has a liquid pressure supply hole providing communication between a liquid pressure supply line and the liquid pressure supply chamber and applying liquid supply pressure to a first end surface of the valve body. A liquid discharge hole which communicates between a liquid deischarge line and the liquid discharge side chamber and is closed by a second end surface of the valve body when the liquid pressure in the liquid pressure supply chamber is higher than the liquid pressure in the liquid discharge side chamber. A connecting hole is provided between the pump liquid discharge hole and the liquid discharge side chamber.

A check valve may be incorporated in the pump liquid supply hole or in a liquid supply line connecting between the pump liquid supply hole and the liquid supply source.

In addition, a spring member may be disposed in the hollow portion in the shuttle valve for biasing the valve body toward the liquid discharge hole of the shuttle valve to assist the liquid supply pressure.

According to the present invention having the above-described arrangement, the valve body of the shuttle valve is automatically moved in the hollow portion of the valve casing by the pressure differential between the supply pressure of the liquid supplied from the liquid supply line or the liquid pressure supply line and the delivery pressure of the liquid discharged from the plunger pump. Accordingly, the valve body closes the shuttle valve liquid discharge hole during the suction stroke or when the pump is standing by, and, in the first aspect of the invention, it further closes the liquid supply hole of the shuttle valve during the delivery stroke. Therefore, even when the supply pressure of the liquid is higher than the atmospheric pressure, it is possible to prevent the liquid from flowing out to the jet washing machine from the plunger pump during the suction stroke or when the pump is standing by without the need for employing a stop valve as in the prior art.

Although the stop valve conventionally used needs a seal mechanism because the valve unit is externally driven, the present invention is not provided with such a seal mechanism and hence free from the problems attendant on the stop valve used in the prior art, e.g., generation of dust from the seal mechanism, leakage of the liquid to the outside, and failure of the seal mechanism. In addition, since no driving unit is needed for the shuttle valve, no special maintenance for valve driving is needed.

PREFERRED EMBODIMENT OF THE INVENTION

Some embodiments of the present invention will be described below with reference to FIGS. 1 to 7.

Figure 1:
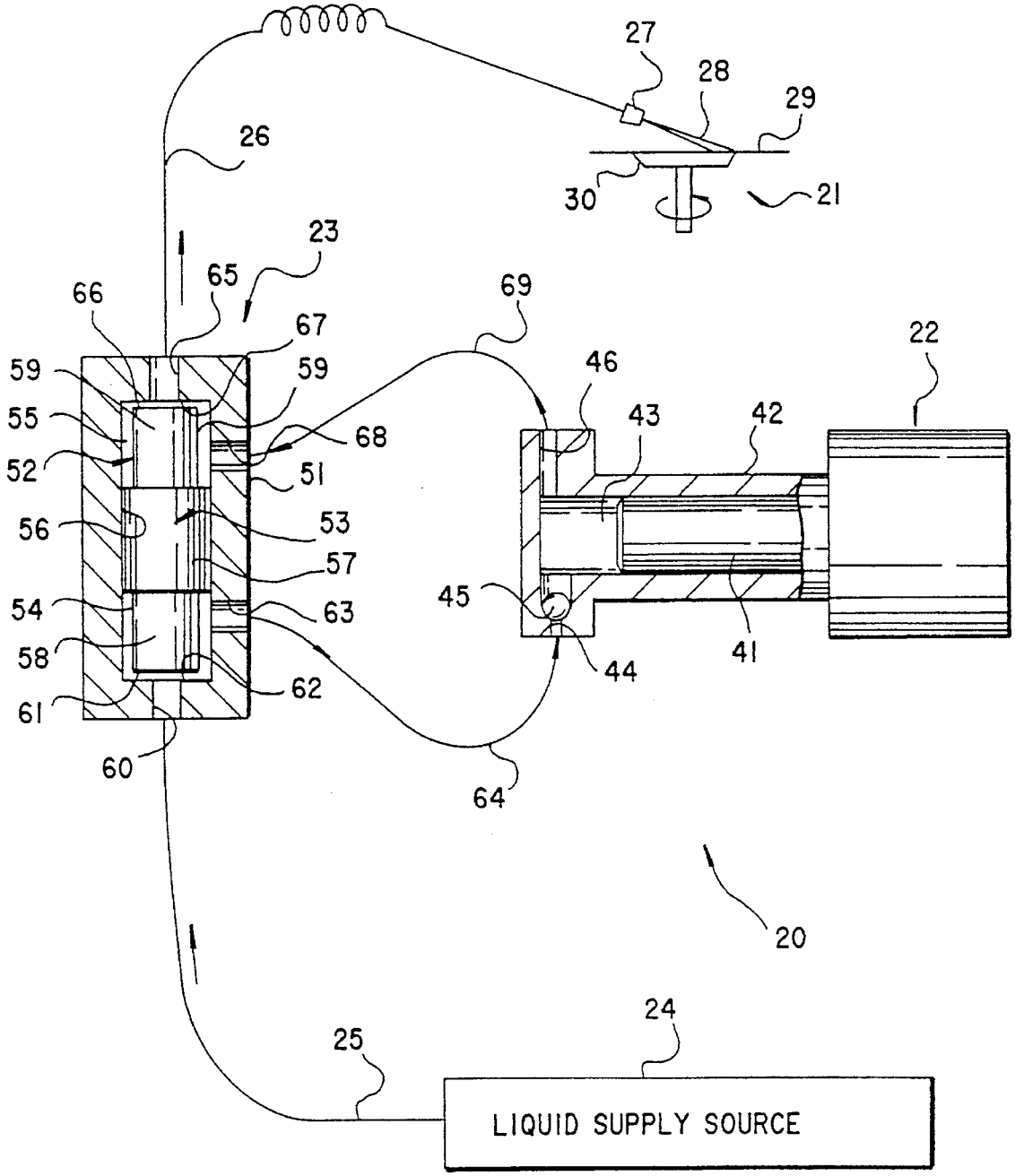
FIG. 1 is a partial sectional view showing the general arrangement of a plunger pump system with shuttle valve according to a first embodiment of the present invention.

FIG. 1 shows the general arrangement of a plunger pump system with shuttle valve according to a first embodiment of the present invention. The figure illustrates the internal structures of a plunger pump and a shuttle valve and the general fluid flow line of the plunger pump system. The plunger pump system 20 with a shuttle valve according to the present invention is employed in a cleaning process that requires a high degree of cleanliness as in the manufacture of semiconductors, liquid crystals, etc. The plunger pump system 20 has a plunger pump 22 for supplying an ultraclean liquid to a jet washing machine 21 that sprays a high-pressure liquid, and a shuttle valve 23 connected to the plunger pump 22.

As illustrated, the liquid is supplied from a liquid supply source 24 through a liquid supply line 25. After passing through the shuttle valve 23, the liquid is pressurized by the plunger pump 22. Then, the liquid passes through the shuttle valve 23 again, and thereafter, it is supplied to the jet washing machine 21 through a liquid discharge line 26. At the jet washing machine 21, the liquid is sprayed in the form of a jet 28 on the surface of an object 29 to be washed, e.g., a wafer. The object 29 is rotated on a rotary table 30 which is driven to rotate so that foreign matter attached to the surface of the object 29 is removed by the jet 28 of a liquid.

In the plunger pump 22, a plunger 41 is driven by a crank meachanism or air piston (not shown) to reciprocate in a cylinder 42, thereby enlarging and reducing the volumetric capacity of a pump chamber 43. In addition, a check valve 45 is incorporated in a pump liquid supply hole 44 formed in the cylinder 42 so that the flow of liquid is free only in the direction of the pump chamber 43. Thus, the liquid sucked in from the pump liquid supply hole 44 is pressurized in the pump chamber 43 whose volumetric capacity enlarges and reduces in response to the reciprocating motion of the plunger 41, and the pressuriaed liquid is discharge from a pump liquid discharge hole 46.

The shuttle valve 23 has a valve casing 51 formed with a hollow portion 52 having a circular cross-sectional configuration. A valve body 53 is reciprocatably fitted in the hollow portion 52 to divide it into a liquid supply side chamber 54 and a liquid discharge side chamber 55. The valve body 53 has a large-diameter portion 57 that slides along the inner peripheral surface 56 of the valve casing 51 with a slight clearance provided therebetween, and a pair of small-diameter portions 58 and 59 which are integrally formed at the lower and upper ends (as viewed in the figure), respectively, of the large-diameter portion 57 in concentrical relation to it. The small-diameter portions 58 and 59 each have a predetermined gap between the same and the inner peripheral surface 56 for allowing the liquid to pass.

The valve casing 51 is formed with a liquid supply hole 60 which provides communication between the liquid supply line 25 and the liquid supply side chamber 54. When the delivery pressure of the liquid discharged from the plunger pump 22 is higher than the supply pressure of the liquid supplied from the liquid supply line 25, the valve body 53 moves downwardly (as viewed in the figure) to close the liquid supply hole 60 by a first end surface 61 of the valve body 53. That is, when the valve body 53 moves downwardly (as viewed in the figure), the first end surface 61 comes in close contact with the inner end surface 62 at the lower end (as viewed in the figure) of the valve casing 51, thereby closing the liquid supply hole 60.

The valve casing 51 is formed with a first connecting hole 63 that provides communication between the pump liquid supply hole 44 and the liquid supply side chamber 54. The first connecting hole 63 is disposed at a position where it is always in communication with the liquid supply side chamber 54 irrespective of the reciprocating motion of the valve body 53, and it is connected to the pump liquid supply hole 44 through a connecting line 64.

The valve casing 51 is formed with a liquid discharge hole 65 that provides communication between the liquid discharge line 26 and the liquid discharge side chamber 55. When the supply pressure of the liquid in the liquid supply line 25 is higher than the delivery pressure of the liquid from the plunger pump 22, the valve body 53 moves upwardly (as viewed in the figure) to close the liquid discharge hole 65 by a second end surface 66 of the valve body 53. That is, when the valve body 53 moves upwardly (as viewed in the figure), the second end surface 66 comes into close contact with the inner end surface 67 at the upper end (as viewed in the figure) of the valve casing 51, thereby closing the liquid discharge hole 65.

The valve casing 51 is further formed with a second connecting hole 68 that provides communication between the pump liquid discharge hole 46 and the liquid discharge side chamber 55. The second connecting hole 68 is formed at a position where it is always in communication with the liquid discharge side chamber 55 irrespective of the reciprocating motion of the valve body 53, and it is connected to the pump liquid discharge hole 46 through a connecting line 69.

Next, the operation of the plunger pump system 20 with shuffle valve will be explained in relation to the suction and delivery operations of the plunger pump 22.

During the suction stroke of the pump, as the plunger 41 is moved rightwardly (as viewed in the figure) by the operation of a crank mechanism or the like (not shown), the volumetric capacity of the pump chamber 43 enlarges. Consequently, the liquid is casued to pass through the liquid supply line 25 and flow into the liquid supply hole 60 by the pressure applied from the liquid supply source 24. Thus, the liquid passes through the liquid supply side chamber 54 while pushing up the valve body 53 and then flows into the pump liquid supply hole 44 through the first connecting hole 63 and via the connecting line 64. The liquid flows into the pump chamber 43 while pushing up the check valve 45.

The valve body 53 as pushed upwardly (as viewed in the figure) in this way closes the liquid discharge hole 65. Therefore, there is no possibility of the liquid flowing in the direction of the nozzle 27 of the jet washing machine 21. In addition, once the valve body 53 closes the liquid discharge hole 65, it is constantly pressed upwardly from the direction of the liquid supply hole 60 by the supply pressure of the liquid. Thus, the shuttle valve liquid discharge hole 65 can continuously maintain its closed state.

Next, during the delivery stroke of the pump, as the plunger 41 moves leftwardly (as viewed in the figure), the volumetric capacity of the pump chamber 43 is reduced. Accordingly, the liquid is pushed out of the pump chamber 43 through the pump liquid discharge hole 46. At this time, since the pump liquid supply hole 44 has the check valve 45 incorporated therin, the liquid flows into the second connecting hole 68 from the pump liquid discharge hole 46 through the connecting line 69 without the possibility of the liquid flowing back. The high-pressure liquid flowing into the liquid discharge side chamber 55 from the second connecting hole 68 pushes back the valve body 53 toward the liquid supply hole 60 by the pressure thereof. Therefore, the liquid supply hole 60 is closed, while the liquid discharge hole 65 is opened. Accordingly, the discharged liquid that has flowed in the liquid discharge side chamber 55 flows out from the liquid discharge hole 65 and is supplied to the nozzle 27 of the jet washing machine 21 via the liquid discharge line 26. The liquid supplied to the nozzle 27 spouts therefrom in the form of a high-speed jet 28 of liquid to wash the object 29.

Thus, the system 20 of this embodiment is provided with no mechanism for externally driving the shuttle valve 23 but utilizes a pressure difference in the plunger pump system 20 to automatically close and open the shuttle valve 23 instead. Accordingly, there is no likelihood of generation of dust from a seal mechanism which would otherwise be needed for a sliding portion that connects together a valve unit associated with the pump system and an external driving mechanism, and there is no possibility of the liquid leaking to the outside. In addition, this embodiment is free from failure of a diaphragm or a bellows as occurs in the conventional system.

Incidentally, in the aforementioned embodiment, the check valve 45 may be incorporated in the connecting line 64 instead of providing in the pump liquid supply hole 44.

Figure 1A:
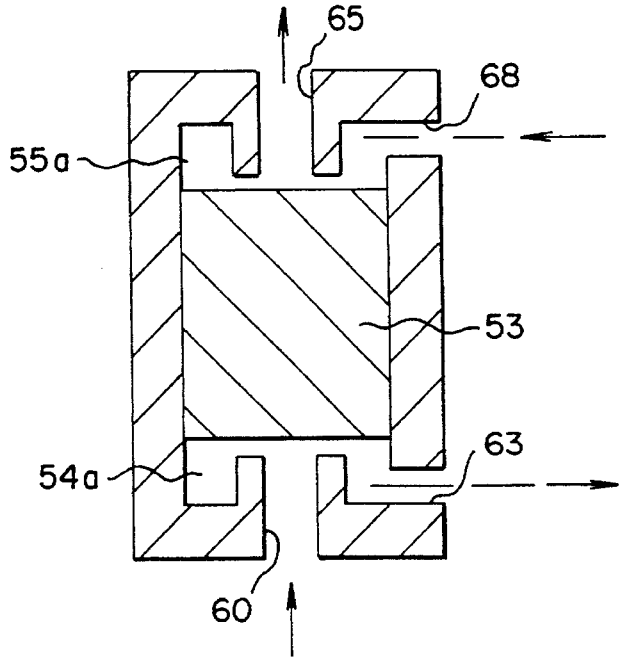
FIG. 1A is a sectional view showing a shuttle valve according to an other embodiment of the invention.

Further, the liquid supply side chamber 54a and the liquid discharge side chamber 55*a* may be formed without changing the diameter of the valve body 53 as shown in FIG. 1A.

Figure 2:
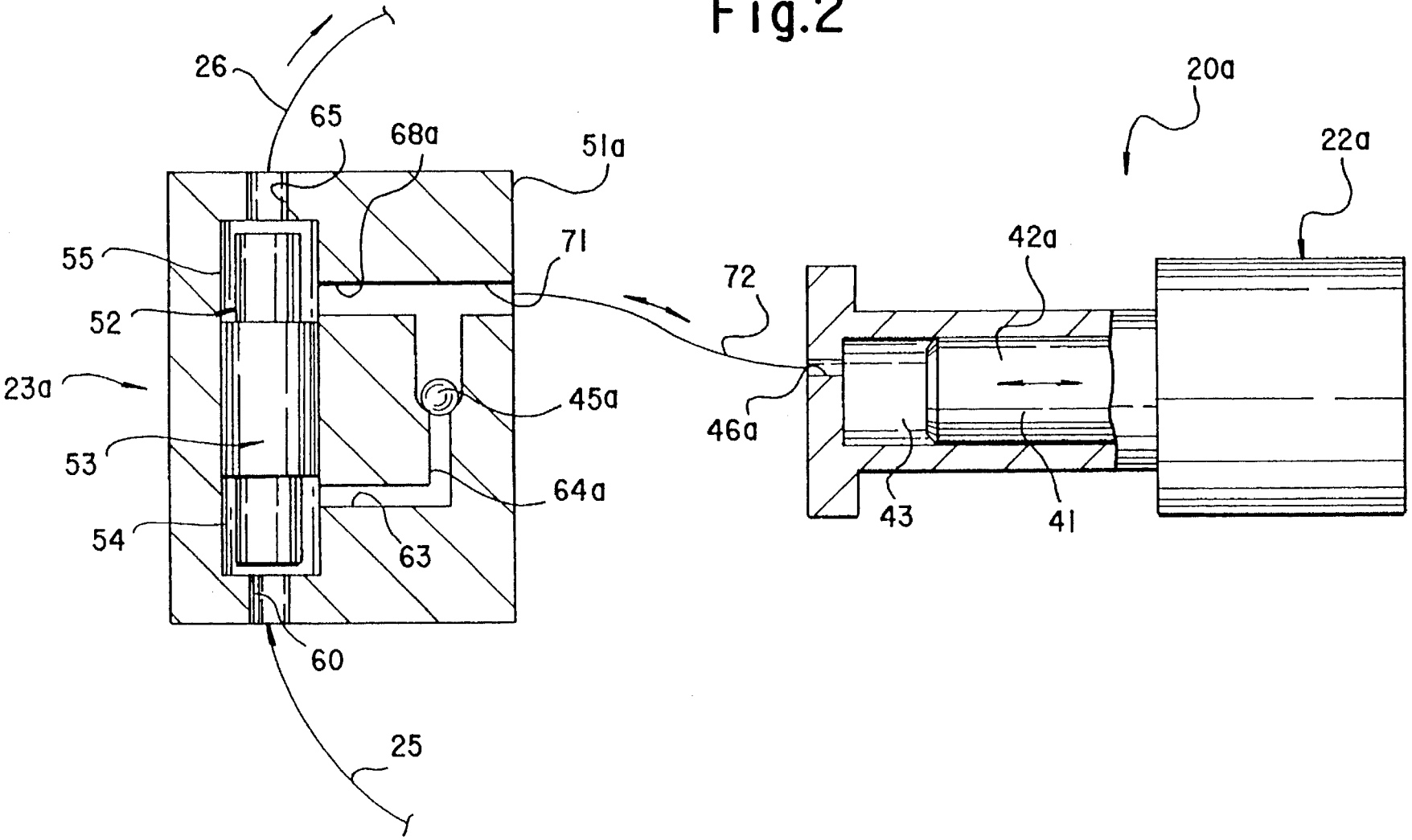
FIG. 2 is a partial sectional view showing the general arrangement of a plunger pump system with shuttle valve according to a second embodiment of the present invention.

FIG. 2 is a partial sectional view showing the general arrangement of a plunger pump system 20*a* with a shuttle valve according to a second embodiment of the present invention. In the plunger pump system 20*a*, a check valve 45*a* of a plunger pump 22*a* is incorporated in a valve casing 51*a* of a shuttle valve 23*a*. The first and second connecting holes 63 and 68*a* of the shuttle valve are connected to each other by a passage 64*a* formed in the valve casing 51*a* and the check valve 45*a* is disposed in the passage 64*a*. The cylinder 42*a* of the plunger pump 22*a* is formed with a hole 46*a*, which serves as a pump liquid supply hole and a pump liquid discharge hole.

The valve casing 51*a* is formed with a communicating hole 71 which is in communication with the passage 64*a* at the down stream of the check valve 45*a*. The communicating hole 71 and the pump liquid discharge hole 46*a* are connected by a line 72. The arrangement and operation of the valve body 53, which reciprocates in the hollow portion 52 formed in the valve casing 51*a*, are the same as in the first embodiment.

Accordingly, during the suction stroke of the pump, the volumetric capacity of the pump chamber 43 is enlarged by the rightward (as viewed in the figure) movement of the plunger 41. Consequently, the liquid flowing into the liquid supply hole 60 pushes up the valve body 53, and while doing so, it passes through the liquid supply side chamber 54, the first connecting hole 63 and the passage 64*a* and then pushes up the check valve 45*a*. Then, the liquid flows into the pump chamber 43 through the communicating hole 71, the line 72, and the pump liquid supply/discharge hole 46*a*. At this time, the liquid discharge hole 65 of the shuttle valve is closed by the valve body 53 pushed up in the same way as in the first embodiment.

Next, during the delivery stroke of the pump, the plunger 41 moves leftwardly (as viewed in the figure) to reduce the volumetric capacity of the pump chamber 43. Consequently, the pressurized liquid flows into the liquid discharge side chamber 55 through the pump liquid supply/discharge hole 46*a*, the line 72, the communicating hole 71, and the second connecting hole 68*a*, causing the valve body 53 to be pushed back downwardly. Thus, the shuttle valve liquid supplly hole 60 is closed. Since back flow of the liquid is prevented by the check valve 45*a*, the liquid in the liquid discharge side chamber 55 flows into the liquid discharge line 26 through the liquid discharge hole 65.

Accordingly, the system 20*a* of this embodiment requires only one line 72 for connection between the plunger pump 22*a* and the shuttle valve 23*a*. Therefore, the whole structure is simplified.

Figure 3:
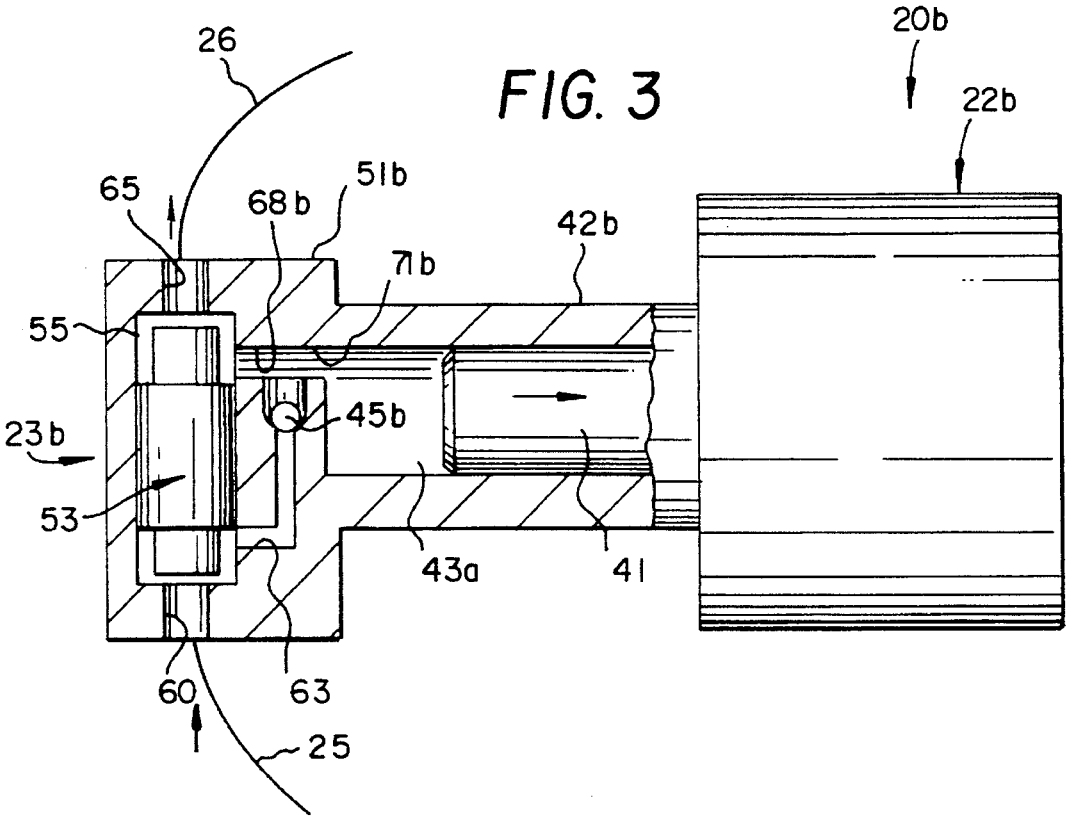
FIG. 3 is a partial sectional view showing the general arrangement of a plunger pump system with shuttle valve according to a third embodiment of the present invention.

FIG. 3 is a partial sectional view showing the general arrangement of a plunger pump system 20*b* with shuttle valve according to a third embodiment of the present invention. In this embodiment, a shuttle valve 23*b* is integrally formed with a plunger pump 22*b*, thereby further simplifying the whole structure. That is, the valve casing 51*b* of the shuttle valve 23*b* is united with the cylinder 42*b* of the plunger pump 22*b*.

In addition, the pump chamber 43*a* and the liquid discharge side chamber 55 are communicated with each other through a communicating hole 71*b* and a shuttle valve second connecting hole 68*b*, which are formed in the valve casing 51*b*. It should be noted that a check valve 45*b* is incorporated in a passage 63 formed in the valve casing 51*b* in the same way as in the second embodiment. Accordingly, the system 20*b* of this embodiment has an arrangement in which the line 72 in the second embodiment is omitted, but the communicating hole 71 and the pump liquid supply/discharge hole 46*a*, shown in FIG. 2, are directly connected and fixed to each other. Therefore, the operations during the suction and delivery strokes of the plunger pump 22*b* are the same as in the second embodiment.

In the third embodiment, since the shuttle valve 23*b* and the plunger pump 22*b* are united together, the whole system can be reduced in size, and it becomes extremely easy to handle the pump system.

Figure 4:
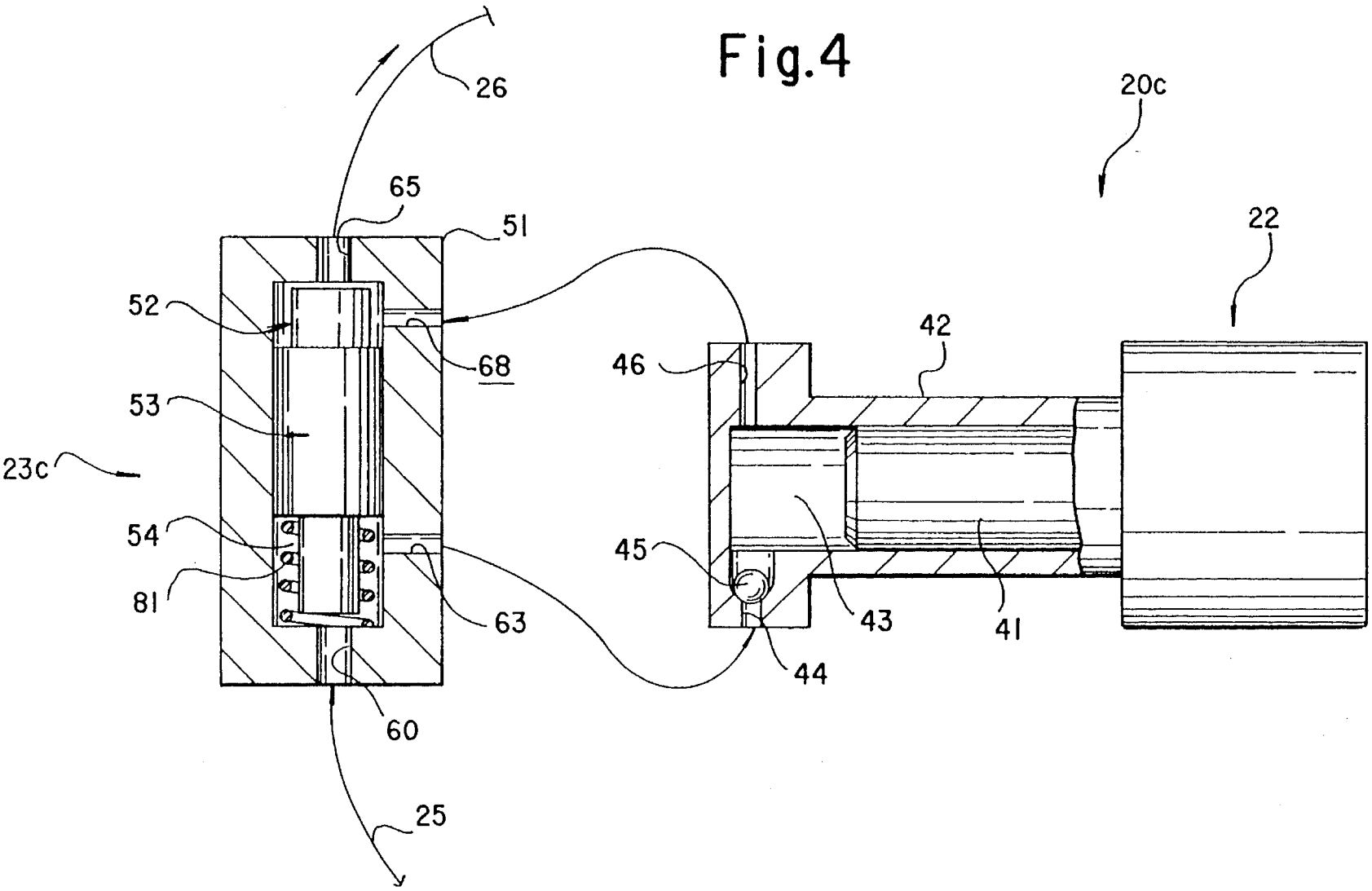
FIG. 4 is a partial sectional view showing the general arrangement of a plunger pump system with shuttle valve according to a fourth embodiment of the present invention.

FIG. 4 is a partial sectional view showing the general arrangement of a plunger pump system 20*c* with shuttle valve according to a fourth embodiment of the present invention. In this embodiment, a compression spring 81 is disposed in the hollow portion 54 of the valve casing 51 as a spring member for biasing the valve body 53 of the shuttle valve 23*c* toward the liquid discharge hole 65 to assist the supply pressure of the liquid. The compression spring 81 is fitted in the liquid supply side chamber 54 to constantly push up the valve body 53 toward the liquid discharge hole 65. With the shuttle valve 23*c* having the above-described arrangement, even when the pressure of the liquid supplied to the liquid supply hole 60 from the liquid supply line 25 is relatively low, during the suction stroke of the plunger pump 22, the valve body 53 is pushed upwardly (as viewed in the figure) by the spring force from the compression spring 81. Thus, the pump system of this embodiment performs a similar operation to that of the first embodiment.

During the delivery stroke of the pump, since the delivery pressure of the liquid is larger than the spring force of the compression spring 81, the valve body 53 is pushed downwardly (as viewed in the figure). Thus, the pump system of this embodiment performs a similar operation to that of the first embodiment.

Figure 6:
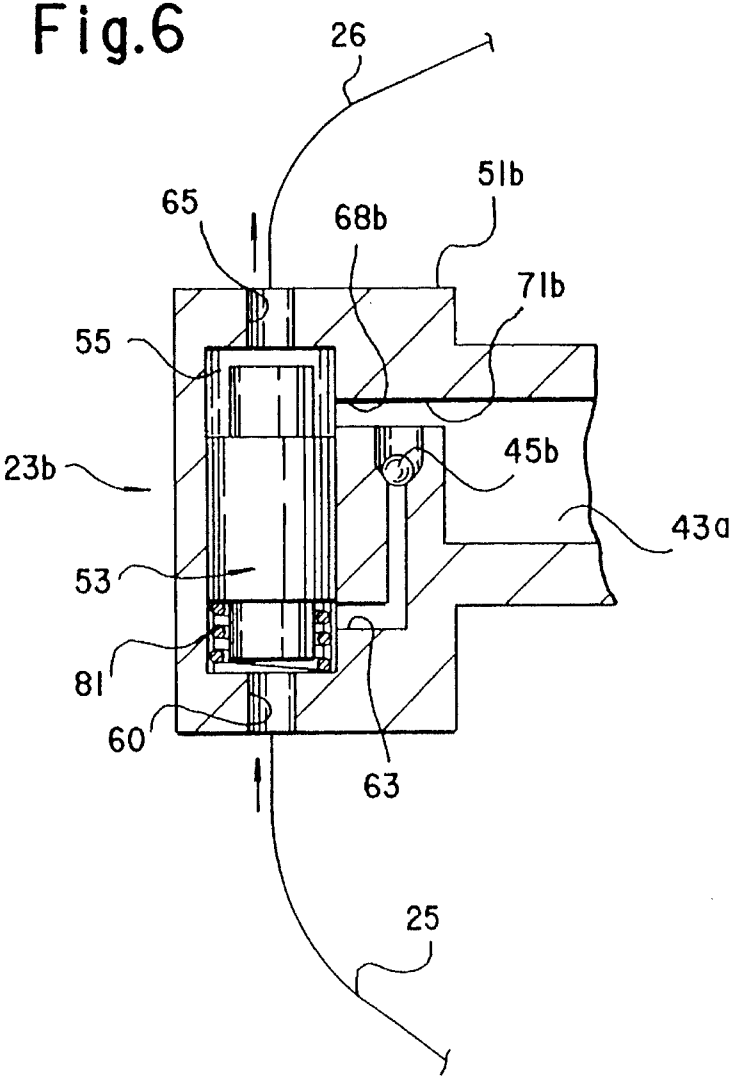
FIG. 6 is a sectional view showing a shuttle valve according to a still further embodiment of the invention.
Figure 5:
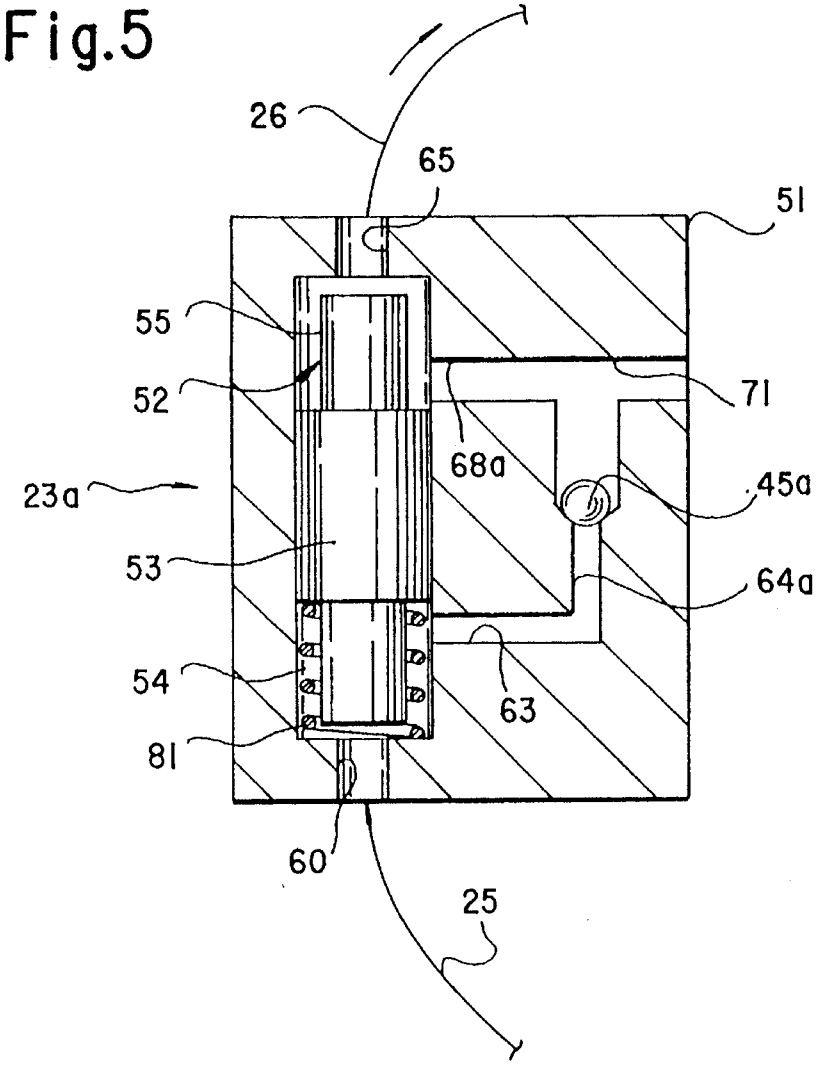
FIG. 5 is a sectional view showing a shuttle valve according to a further embodiment of the invention.

It should be noted that the same advantageous effect can be obtained by providing a tension spring in the liquid discharge side chamber 52 as a spring member instead of the compression spring 81. It is also possible to apply a spring member 81 to the shuttle valve 23*a*, 23*b* in the second and third embodiments as shown in FIGS. 5 and 6.

Thus, according to the fourth embodiment, even when the difference between the supply pressure of the liquid and the atmospheric pressure is relatively small, the shuttle valve liquid discharge hole 65 can be stably closed. Thus, leakage of liquid can be reliably prevented.

Figure 7:
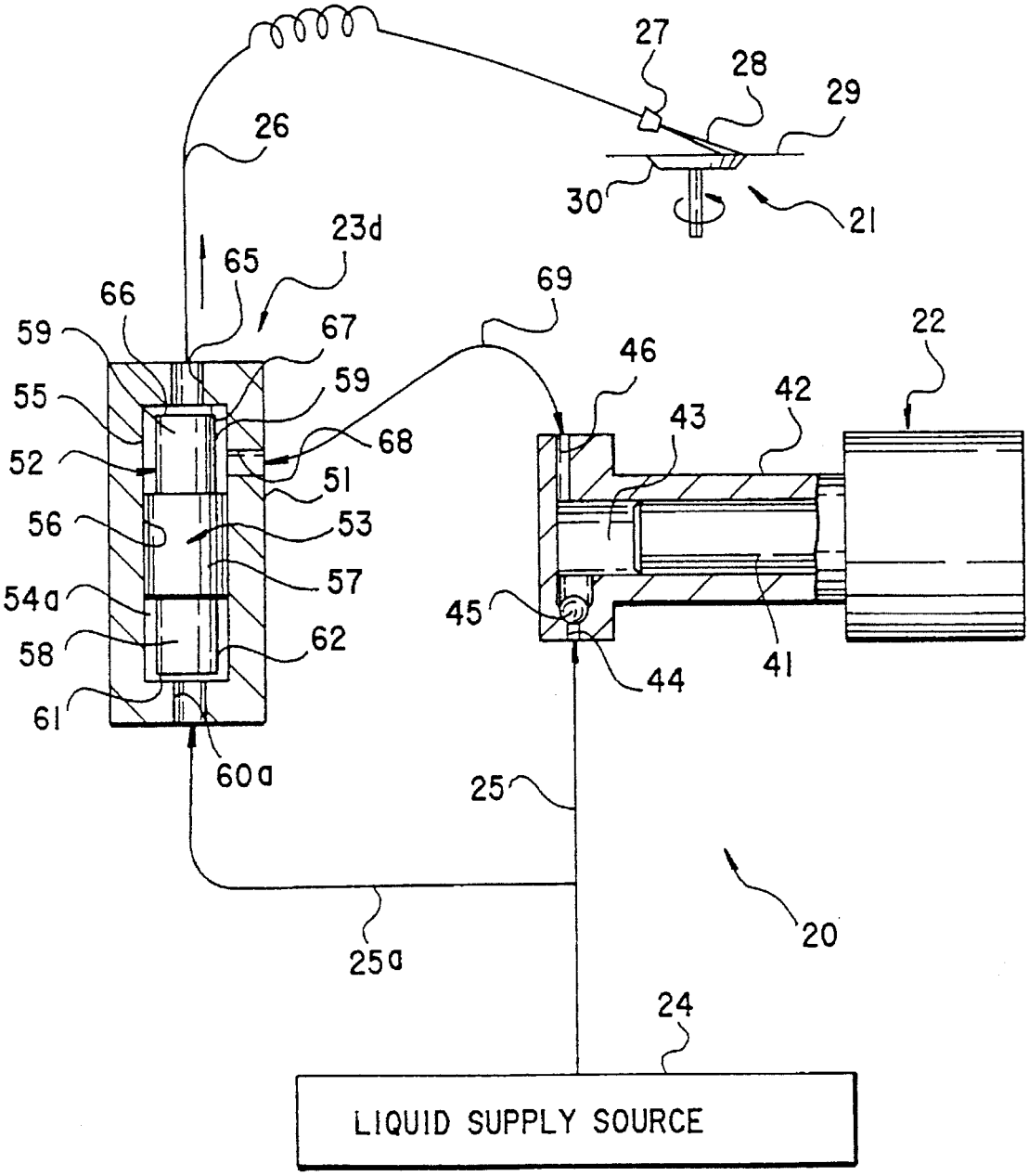
FIG. 7 is a partial sectional view showing the general arrangement of a plunger pump system with shuttle valve according to a fifth embodiment of the present invention.
Figure 8:
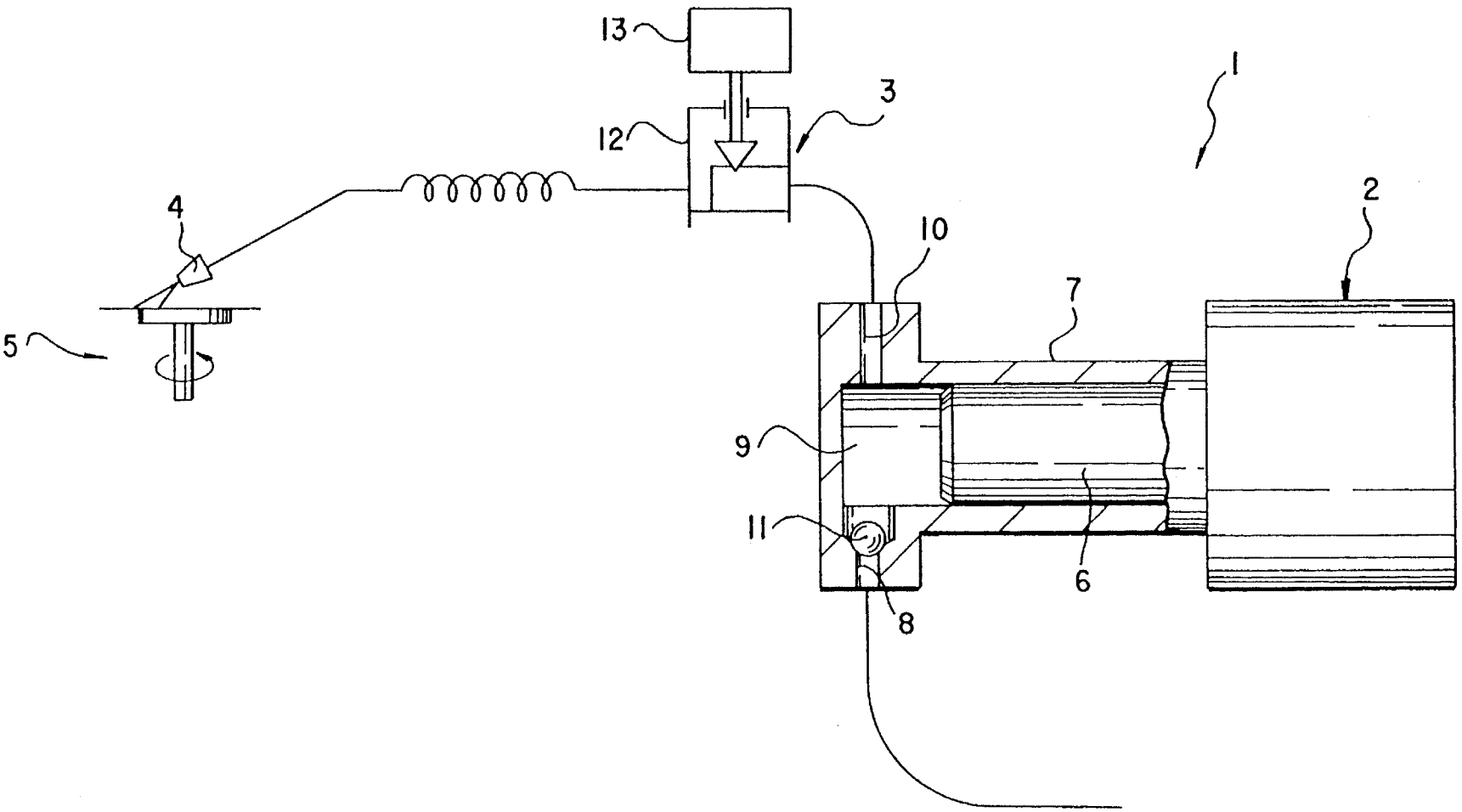
Fig.8 PRIOR ART
FIG. 8 is a partial sectional view showing the general arrangement of a conventional plunger pump system.

FIG. 7 shows a fifth embodiment of the present invention.

The general arrangement of this embodiment is similar to that of the first embodiment except for the following points.

In this embodiment, a liquid is directly supplied to the pump chamber 43 from the liquid supply source 24 through the liquid supply line 25, the pump liquid supply hole 44 and the check valve 45 without passing through a shuttle valve 23*d*.

The hollow portion of the shuttle valve is divided into a liquid pressure supply chamber 54*a* and the liquid discharge side chamber 55 by the valve body 53. The shuttle valve is provided with a liquid pressure supply hole 60*a* which provides communication between a liquid pressure supply line 25*a* connected to the liquid supply line 25 and the liquid pressure supply chamber 54*a* for applying the liquid supply pressure to the first end surface 61 of the valve body 53.

In this embodiment, during the suction stroke of the pump, as the plunger 41 is moved rightwardly (as viewed in the figure), since the pressure in the liquid discharge side chamber 55 communicated to the pump chamber 43 is made lower than that of the liquid supply pressure in the liquid pressure supply chamber 54*a*, the valve body 53 is pushed up and the liquid discharge hole 65 is closed by the second end surface 66 of the valve body 53.

During the delivery stroke of the pump, as the plunger 41 moves leftwardly (as viewed in the figure), since the pressure in the liquid discharge side chamber 55 communicated to the pump chamber 43 is higher than that in the liquid pressure supply chamber 54*a*, the valve body 53 is pushed back toward the liquid pressure supply hole 60*a*. Therefore, the discharge liquid that has flowed in the liquid discharge side chamber 55 flows out from the liquid discharge hole 65 and is supplied to the nozzle 27 through the liquid discharge line 26.

Thus, the plunger pump system of this embodiment effects operation similar to that of the first embodiment.

Also, in this embodiment, the check valve 45 may be incorporated in the liquid supply line 25 instead of the pump liquid supply hole 44.

In addition, a spring member 81 may be disposed in the hollow portion 52 in the shuttle valve for biasing the valve body 53 toward the liquid discharge hole 65 to assist the liquid supply pressure.

As has been described above, the present invention has a valve that is automatically closed and opened by making use of the pressure difference in the pump without employing a mechanism for externally driving a valve. Accordingly, there is no likelihood of dust being generated from a seal mechanism which would otherwise be needed for a sliding portion that connects together a valve associated with the pump system and an externally driving mechanism, and there is no possibility of the liquid leaking to the outside through the seal mechanism. In addition, the present invention is free from failure of a seal mechanism as occurs in a diaphragm or a bellows in the conventional system.

Further, the present invention does not require any special maintenance to maintain proper functioning of a valve driving unit, thereby enabling a reduction in costs for operating a plunger pump system.

I claim:

1. A plunger system comprising:

a plunger pump having a plunger which reciprocates in a cylinder so that a liquid, which is sucked into a pump chamber from a pump liquid supply through a check valve, which allows the liquid to flow only in the direction of said pump chamber, is pressurized in said pump chamber and discharged from a pump liquid discharge; and a shuttle valve connected to said plunger pump and having a valve body reciprocally fitted in a hollow portion formed in a valve casing to divide said hollow portion into a liquid supply side chamber and a liquid discharge side chamber, said shuttle valve connected to said plunger pump having a liquid supply hole which provides communication between a liquid supply line and said liquid supply side chamber and which is closed by a first end surface of said valve body when a liquid pressure in said liquid discharge side chamber is higher than a liquid pressure in said liquid supply side chamber, a first connecting hole which provides communication between said pump liquid supply and said liquid supply side chamber, a liquid discharge hole which provides communication between a liquid discharge line and said liquid discharge side chamber and which is closed by a second end surface of said valve body when said liquid pressure in said liquid supply side chamber is higher than said liquid pressure in said liquid discharge side chamber, and a second connecting hole which provides communication between said pump liquid discharge and said liquid discharge side chamber, said pump liquid supply and said pump liquid discharge are through a common hole, said first and second connecting holes are communicated to each other through a passage formed in said shuttle valve connected to said plunger pump, said check valve is provided in said passage, and said common hole of said pump is connected to said passage downstream side of said check valve.

2. A plunger pump system according to claim 1, wherein said shuttle valve is formed independently of said plunger pump and said common hole is connected to said passage.

3. A plunger pump system according to claim 1, wherein said shuttle valve is integrally formed with said plunger pump and said common hole is directly connected to said passage.

4. A plunger pump system according to any one of claim 1 to 3, wherein a spring member is disposed in said hollow portion of said shuttle valve for biasing said valve body toward said liquid discharge hole of said shuttle valve.

* * * * *